US009110432B2

(12) United States Patent
Ono et al.

(10) Patent No.: US 9,110,432 B2
(45) Date of Patent: Aug. 18, 2015

(54) IMAGE FORMING APPARATUS INCLUDING A CLEANING ROLLER WITH A RESISTANCE LAYER

(71) Applicants: Hiroshi Ono, Tokyo (JP); Takeshi Yamamoto, Kanagawa (JP); Keisuke Kawabata, Kanagawa (JP)

(72) Inventors: Hiroshi Ono, Tokyo (JP); Takeshi Yamamoto, Kanagawa (JP); Keisuke Kawabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/220,247

(22) Filed: Mar. 20, 2014

(65) Prior Publication Data

US 2014/0294473 A1 Oct. 2, 2014

(30) Foreign Application Priority Data

Mar. 29, 2013 (JP) ..... 2013-072070

(51) Int. Cl.
*G03G 21/00* (2006.01)

(52) U.S. Cl.
CPC ..... *G03G 21/0035* (2013.01)

(58) Field of Classification Search
CPC ..... G03G 21/0035
USPC ..... 399/341, 98, 99, 354, 360
See application file for complete search history.

(56) References Cited

U.S. PATENT DOCUMENTS

| | | | | |
|---|---|---|---|---|
| 5,608,499 | A * | 3/1997 | Tanaka | 399/99 |
| 7,945,202 | B2 * | 5/2011 | Kimura et al. | 399/354 |
| 2009/0052966 | A1 * | 2/2009 | Yamashita et al. | 399/407 |

FOREIGN PATENT DOCUMENTS

| | | |
|---|---|---|
| JP | 8-083029 | 3/1996 |
| JP | 2000-318864 | * 11/2000 |
| JP | 2001-343860 | * 12/2001 |
| JP | 2004-137076 | 5/2004 |

* cited by examiner

*Primary Examiner* — Sandra Brase
(74) *Attorney, Agent, or Firm* — Oblon, McClelland, Maier & Neustadt, L.L.P.

(57) ABSTRACT

An image forming apparatus includes a fixing unit and a cleaning unit. The fixing unit includes multiple local heaters configured to separately heat multiple portions of a recording medium carrying toner to fix the toner on the recording medium. The cleaning unit removes unfixed toner adhering to the recording medium after the fixing of the toner performed by the fixing unit.

20 Claims, 8 Drawing Sheets

IMAGE FORMING APPARATUS INCLUDING A CLEANING ROLLER WITH A RESISTANCE LAYER

CROSS-REFERENCE TO RELATED APPLICATION

This patent application is based on and claims priority pursuant to 35 U.S.C. §119(a) to Japanese Patent Application No. 2013-072070, filed on Mar. 29, 2013, in the Japan Patent Office, the entire disclosure of which is hereby incorporated by reference herein.

BACKGROUND

1. Technical Field

The present invention relates to an image forming apparatus.

2. Related Art

Some image forming apparatuses, such as copiers, printers, or facsimile machines, include a fixing device including a heating device for heating a fixing roller, with the heating device divided into a plurality of portions.

In the fixing device, the heating device for heating the fixing roller may be divided into a plurality of portions in a direction perpendicular to a direction of transporting a recording medium, such that the portions of the heating device independently heat a plurality of respective portions of the fixing roller. In such a fixing device, it is possible to control the heating device to heat the fixing roller such that the temperature of a portion of the fixing roller corresponding to a blank area (non-image area) of the recording medium (i.e., an area not formed with an image that is to be fixed on the recording medium) is lower than the temperature of a portion of the fixing roller corresponding to an image area of the recording medium (i.e., an area formed with an image that is to be fixed on the recording medium), thereby reducing the power consumption of the fixing device.

In such a fixing device, however, the portion of the fixing roller corresponding to the blank area of the recording medium is not heated to a fixing temperature. If for some reason toner happens to adhere to the blank area of the recording medium, therefore, the recording medium is discharged to the outside of the image forming apparatus with the toner unfixed on the recording medium, preventing formation of a favorable image and staining a hand of a person touching the recording medium.

SUMMARY

The present invention provides an improved image forming apparatus that, in one example, includes a fixing unit and a cleaning unit. The fixing unit includes multiple local heaters configured to separately heat multiple portions of a recording medium carrying toner to fix the toner on the recording medium. The cleaning unit is configured to remove unfixed toner adhering to the recording medium after the fixing of the toner performed by the fixing unit.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
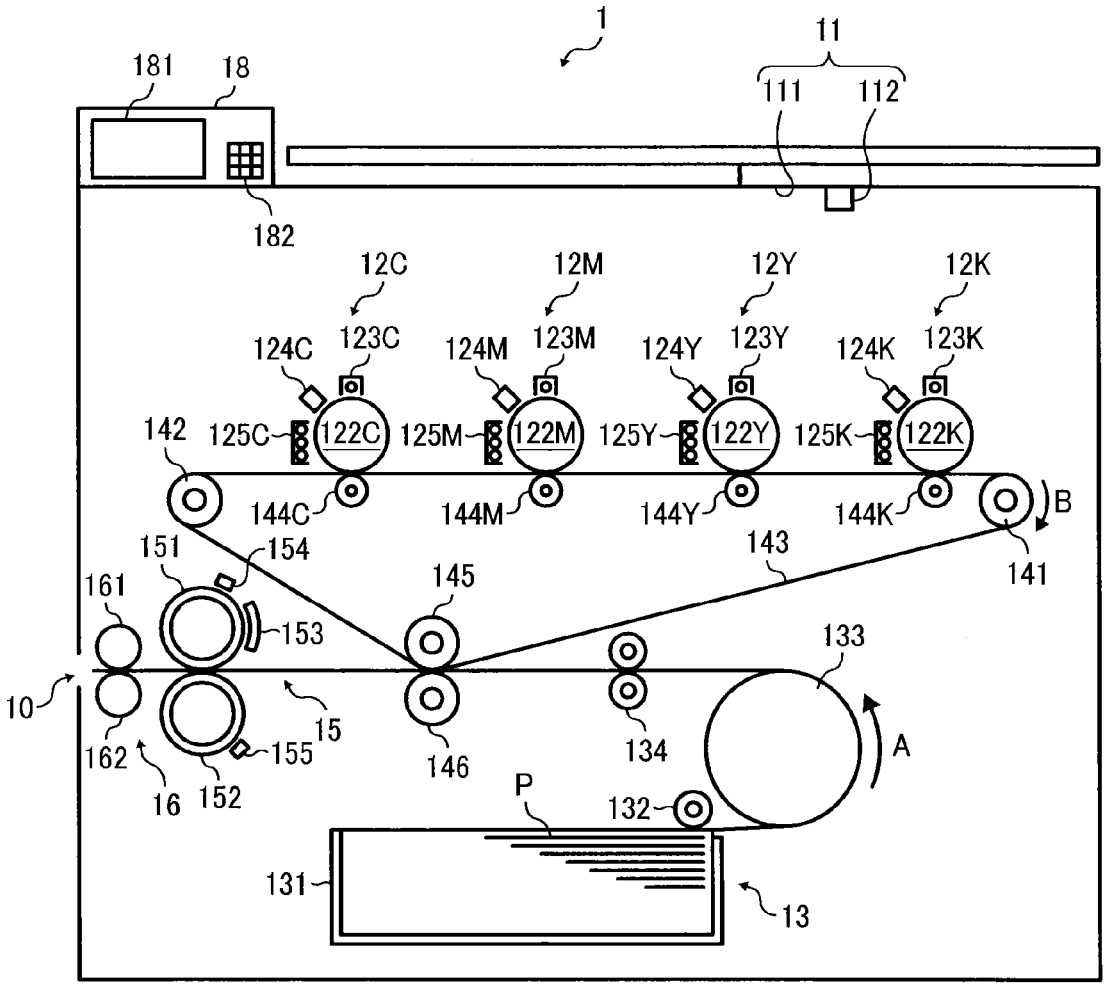
FIG. 1 is a diagram illustrating an overall configuration of an image forming apparatus according to a first embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, particularly to FIGS. 1 to 8, a first embodiment of the present invention will be described.

FIG. 1 is a diagram illustrating an overall configuration of an image forming apparatus 1 according to the present embodiment.

A hardware configuration of the image forming apparatus 1 will first be described. The image forming apparatus 1 forms an image on a sheet S (i.e., a recording medium) by copying, printing, or the like. As illustrated in FIG. 1, the image forming apparatus 1 includes a scanner 11, four image forming units 12C, 12M, 12Y, and 12K, an intermediate transfer belt 143, a drive roller 141, a driven roller 142, primary transfer rollers 144C, 144M, 144Y, and 144K, a secondary transfer roller 145, a secondary transfer facing roller 146, a sheet feeding unit 13, a fixing unit 15, a cleaning unit 16, a discharge port 10, and a control panel (display and operation unit) 18. Although not illustrated in FIG. 1, the image forming apparatus 1 further includes a controller 1000 illustrated in FIGS. 4 and 5.

The scanner 11 forming an uppermost portion of the image forming apparatus 1 includes a contact glass 111 and a read sensor 112. The scanner 11 optically reads a document (not illustrated) placed on the contact glass 111 to generate RGB image information. Specifically, the scanner 11 directs light onto the document and receives light reflected therefrom by using the read sensor 112, which is a charge coupled device (CCD), a contact image sensor (CIS), or the like, to read RGB image information. Herein, the term "RGB image information" refers to the information of the image to be formed on the sheet P including respective brightness values for the colors red (R), green (G), and blue (B).

The image forming unit 12C for forming an image with a toner of cyan (C) color includes a photoconductor drum 122C, a charging unit 123C, an exposure unit 124C, and a development unit 125C. The other image forming units 12M, 12Y, and 12K include photoconductor drums 122M, 122Y, and 122K, charging units 123M, 123Y, and 123K, exposure units 124M, 124Y, and 124K, and development units 125M, 125Y, and 125K, respectively. The image forming units 12M, 12Y, and 12K are similar in configuration to the image forming unit 12C except that the image forming units 12M, 12Y, and 12K form images with toners of magenta (M), yellow (Y), and black (K) colors, respectively.

In the image forming unit 12C, the charging unit 123C, the exposure unit 124C, and the development unit 125C are disposed around the photoconductor drum 122C. The charging unit 123C uniformly charges the outer circumferential surface of the photoconductor drum 122C. The exposure unit 124C forms an electrostatic latent image on the charged outer circumferential surface of the photoconductor drum 122C on the basis of the toner adhesion amount of the toner of the cyan color as determined by the later-described controller 1000. The development unit 125C causes the toner to adhere to the electrostatic latent image formed on the photoconductor drum 122C to form a toner image on the outer circumferential surface of the photoconductor drum 122C. The other image forming units 12M, 12Y, and 12K similarly form toner images of magenta, yellow, and black colors, respectively.

The intermediate transfer belt 143 is stretched around the drive roller 141, the driven roller 142, and the secondary transfer roller 145 to be in contact with the four photoconductor drums 122C, 122M, 122Y, and 122K. As described above, the toner images are formed on the photoconductor drums 122C, 122M, 122Y, and 122K with the toners of the cyan, magenta, yellow, and black colors, respectively. The toner images formed on the photoconductor drums 122C, 122M, 122Y, and 122K are primary-transferred onto the same area of the outer circumferential surface of the intermediate transfer belt 143, thereby forming a combined color toner image on the outer circumferential surface of the intermediate transfer belt 143.

The primary transfer rollers 144C, 144M, 144Y, and 144K are disposed facing the photoconductor drums 122C, 122M, 122Y, and 122K via the intermediate transfer belt 143. To primary-transfer the toner images on the outer circumferential surfaces of the photoconductor drums 122C, 122M, 122Y, and 122K onto the intermediate transfer belt 143, the primary transfer rollers 144C, 144M, 144Y, and 144K supply a primary transfer bias to the intermediate transfer belt 143. Herein, a voltage opposite in polarity to a voltage supplied to the outer circumferential surfaces of the photoconductor drums 122C, 122M, 122Y, and 122K is supplied to the intermediate transfer belt 143 as the primary transfer bias.

The secondary transfer facing roller 146 is disposed at a position facing the secondary transfer roller 145 via the intermediate transfer belt 143. To secondary-transfer the toner image formed on the outer circumferential surface of the intermediate transfer belt 143 onto the sheet P, the secondary transfer roller 145 nips the intermediate transfer belt 143 and the sheet P between the secondary transfer roller 145 and the secondary transfer facing roller 146, and supplies a secondary transfer bias to the sheet P. Herein, a voltage opposite in polarity to the voltage supplied to the outer circumferential surface of the intermediate transfer belt 143 is supplied to the sheet P as the secondary transfer bias.

The sheet feeding unit 13 feeds the sheet P between the secondary transfer roller 145 and the secondary transfer facing roller 146. The sheet feeding unit 13 includes a sheet feeding tray 131, a sheet feeding roller 132, a sheet feeding belt 133, and a registration roller pair 134. The sheet feeding tray 131 stores sheets P. The sheet feeding roller 132 is provided to feed the sheets P stored in the sheet feeding tray 131 to the sheet feeding belt 133. The thus-provided sheet feeding roller 132 picks up the uppermost one of the sheets P stored in the sheet feeding tray 131 and places the sheet P onto the sheet feeding belt 133.

The sheet feeding belt 133 feeds the sheet P picked up by the sheet feeding roller 132 between the secondary transfer roller 145 and the secondary transfer facing roller 146. The registration roller pair 134 is disposed on the sheet feeding belt 133 at a position upstream of the secondary transfer roller 145 in the direction of feeding the sheet P. The registration roller pair 134 times the transport of the sheet P between the secondary transfer roller 145 and the secondary transfer facing roller 146 such that the sheet P reaches the secondary transfer roller 145 at the same time as the area of the intermediate transfer belt 143 formed with the toner image reaches the secondary transfer roller 145.

The fixing unit 15 includes a fixing roller 151, a facing roller 152, a heating unit 153, and temperature gauges 154 and 155. The fixing unit 15 fixes the toner transferred to the sheet P from the intermediate transfer belt 143. Herein, the term "fix" refers to supplying heat and pressure to the toner at the same time to thereby fuse and fix a resin component of the toner on the sheet P. In the fixing unit 15, the fixing roller 151 and the facing roller 152 are disposed facing each other. The fixing roller 151 presses the toner-transferred sheet P against the facing roller 152.

Figure 2:
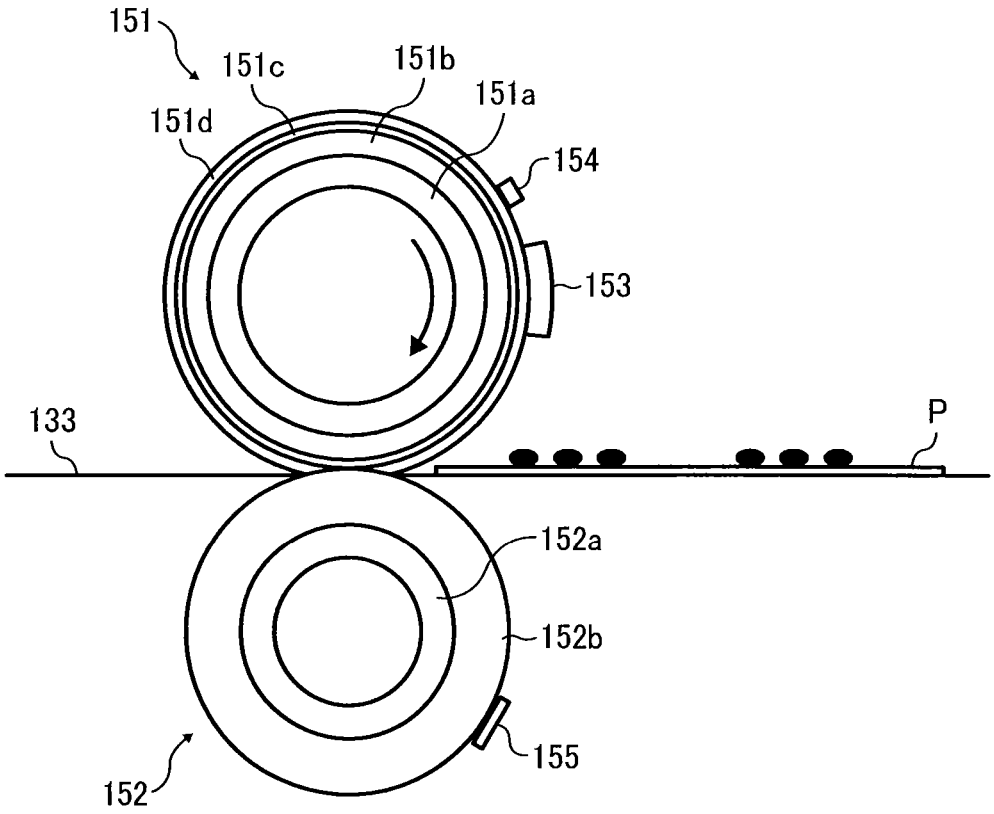
FIG. 2 is a diagram illustrating a configuration of a fixing unit included in the image forming apparatus.

As illustrated in FIG. 2, the fixing roller 151 includes a roller core pipe 151*a*, a heat insulating layer 151*b*, a high thermal conductive layer 151*c*, and a release layer 151*d*. The roller core pipe 151*a* is made of aluminum and has an outer diameter of 40 mm and a thickness of 1 mm. The heat insulating layer 151*b* covering the outer circumferential surface of the roller core pipe 151*a* is made of a silicone rubber and has a thickness of 3 mm.

Further, the high thermal conductive layer 151*c* formed on the outer circumferential surface of the heat insulating layer 151*b* is made of nickel, stainless steel, aluminum, copper, or a graphite sheet higher in thermal conductivity than the heat insulating layer 151*b*. With the thus-formed high thermal conductive layer 151*c*, unevenness in temperature of the fixing roller 151 is reduced. The release layer 151*d* formed on the outer circumferential surface of the high thermal conductive layer 151*c* is made of a fluorine-based resin, such as tetrafluoroethylene-perfluoroalkyl vinyl ether copolymer (PFA) or polytetrafluoroethylene (PTFE), and has a thickness of 5 μm to 30 μm. With the release layer 151*d*, the fixing roller 151 is easily released from the sheet P after pressing the sheet P.

The facing roller 152 includes a roller core pipe 152*a* made of aluminum and having an outer diameter of 40 mm and a thickness of 2 mm and a heat insulating layer 152*b* covering the outer circumferential surface of the roller core pipe 152*a*.

Figure 3:
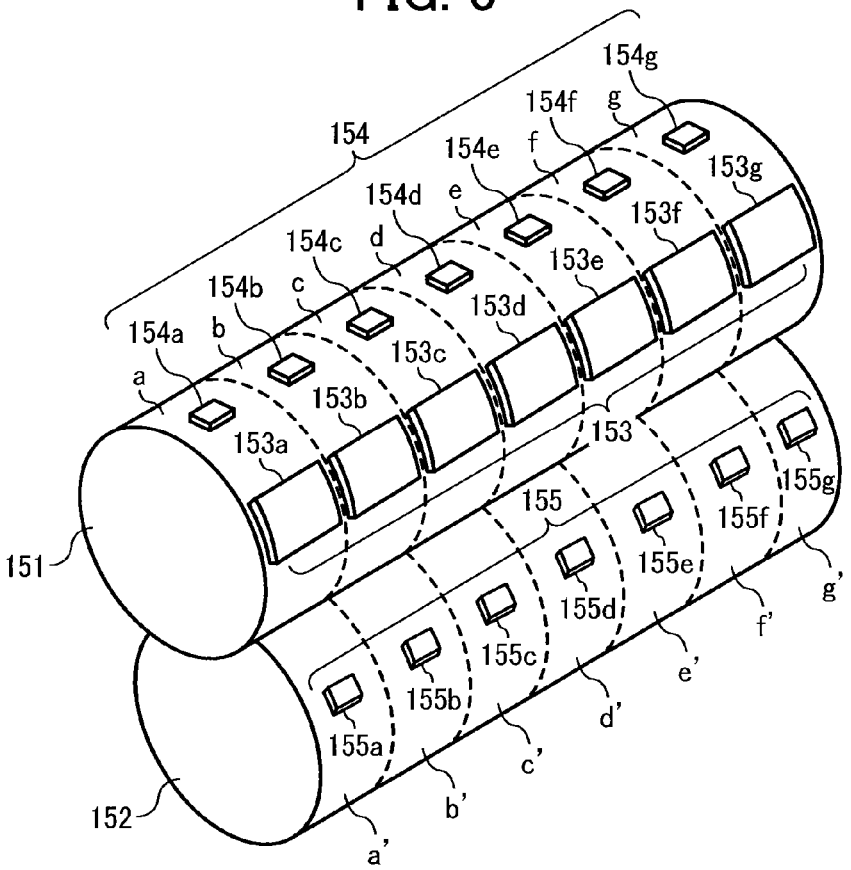
FIG. 3 is a perspective view illustrating the configuration of the fixing unit.

The heating unit 153 is disposed near the outer circumferential surface of the fixing roller 151. FIG. 3 is a perspective view illustrating a configuration of the fixing unit 15. As illustrated in FIG. 3, the heating unit 153 includes heaters (i.e., local heaters) 153*a* to 153*g* aligned in the axial direction of the fixing roller 151 to heat portions of the fixing roller 151. Specifically, the heater 153*a* heats a portion a of the fixing roller 151 illustrated in FIG. 3, and the heater 153*b* heats a portion b of the fixing roller 151. The heaters 153*c* to 153*g* similarly heat portions c to g of the fixing roller 151, respectively.

The temperature gauge 154 for measuring the temperature of the fixing roller 151 is also disposed near the outer circumferential surface of the fixing roller 151. The temperature gauge 154 includes temperature sensors 154*a* to 154*g*. As illustrated in FIG. 3, the temperature sensor 154*a* measures the temperature of the portion a of the fixing roller 151 heated by the heater 153*a*. The temperature sensors 154*b* to 154*g* similarly measure the respective temperatures of the portions b to g of the fixing roller 151.

The temperature gauge 155 for measuring the temperature of the facing roller 152 is disposed near the outer circumferential surface of the facing roller 152. The temperature gauge 155 includes temperature sensors 155*a* to 155*g*. The facing roller 152 is in contact with the fixing roller 151 heated by the heating unit 153 as described above. Therefore, the facing roller 152 is heated by the heat conducted thereto from the fixing roller 151. As illustrated in FIG. 3, the temperature sensor 155*a* measures the temperature of a portion a' of the facing roller 152 facing the portion a of the fixing roller 151 heated by the heater 153*a*. The temperature sensors 155*b* to 155*g* similarly measure the respective temperatures of portions b' to g' of the facing roller 152.

The cleaning unit 16 is disposed downstream of the fixing unit 15 in the direction of transporting the sheet P. The cleaning unit 16 includes a cleaning roller 161 and a cleaning facing roller 162, and cleans unfixed toner on the sheet P having passed through the fixing unit 15. The cleaning roller 161 and the cleaning facing roller 162 form a pair of first and second rollers (the cleaning roller 161 as the first roller and the cleaning facing roller 162 as the second roller). The cleaning unit 16 will be described in detail later.

The sheet P cleaned by the cleaning unit 16 is discharged to the outside of the image forming apparatus 1 through the discharge port 10.

The control panel 18 is disposed on an outer surface of the image forming apparatus 1. The control panel 18 includes a panel display unit 181 and an operation unit 182. The panel display unit 181 is, for example, a touch panel for displaying set values, selection screens, and so forth and receiving inputs. The operation unit 182 includes, for example, numeric keys allowing input of various information relating to image formation and other keys such as a start key allowing input of a start instruction.

Figure 4:
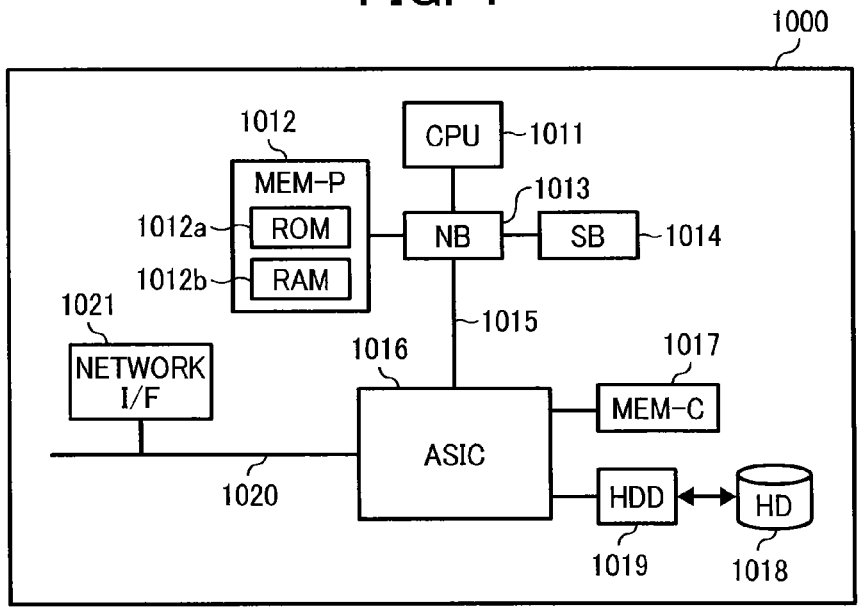
FIG. 4 is a diagram illustrating a hardware configuration of a controller included in the image forming apparatus.

The controller 1000 controls the above-described units of the image forming apparatus 1. FIG. 4 is a diagram illustrating a hardware configuration of the controller 1000 of the image forming apparatus 1 according to the present embodiment. As illustrated in FIG. 4, the controller 1000 includes a central processing unit (CPU) 1011, a main memory (MEM-P) 1012, a north bridge (NB) 1013, a south bridge (SB) 1014, an accelerated graphics port (AGP) bus 1015, an application specific integrated circuit (ASIC) 1016, a local memory (MEM-C) 1017, a hard disk (HD) 1018, a hard disk drive (HDD) 1019, a peripheral component interconnect (PCI) bus 1020, and a network interface (I/F) 1021.

The CPU 1011 processes data and controls the operations of the above-described units in accordance with a program stored in the MEM-P 1012. The MEM-P 1012 serving as a storage area of the controller 1000 includes a read only memory (ROM) 1012*a* and a random access memory (RAM) 1012*b*. The ROM 1012*a* stores programs and data for implementing the functions of the controller 1000. The program stored in the ROM 1012*a* may be provided to the image forming apparatus 1 as recorded in a computer-readable recording medium, such as a compact disc read only memory (CD-ROM), a floppy disk (FD), a compact disc recordable (CD-R), or a digital versatile disc (DVD), in an installable or executable form.

The RAM 1012*b* is used as a memory for reading programs and data or plotting in memory printing. The NB 1013 is a bridge for connecting the CPU 1011, the MEM-P 1012, the SB 1014, and the AGP bus 1015. The SB 1014 is a bridge for connecting the NB 1013 and a peripheral device. The AGP bus 1015 is a bus interface for a graphics accelerator card for increasing the speed of graphics processing. The ASIC 1016 includes a memory controller for controlling the MEM-C 1017 and a plurality of direct memory access controllers (DMACs) that perform rotation of image data with hardware logic, for example. The ASIC 1016 is connected to the network I/F 1021, such as a universal serial bus (USB) interface or an institute of electrical and electronics engineers (IEEE) 1394 interface, via the PCI bus 1020.

The MEM-C 1017 is a local memory used as a copy image buffer and a code buffer. The HD 1018 is a storage for storing image data, font data for use in printing, and forms. The HDD 1019 controls data reading and writing from and to the HD 1018 under the control of the CPU 1011. The network I/F 1021 transmits and receives information to and from an external device, such as an information processor, via a communication network.

A functional configuration of the image forming apparatus 1 will now be described.

Figure 5:
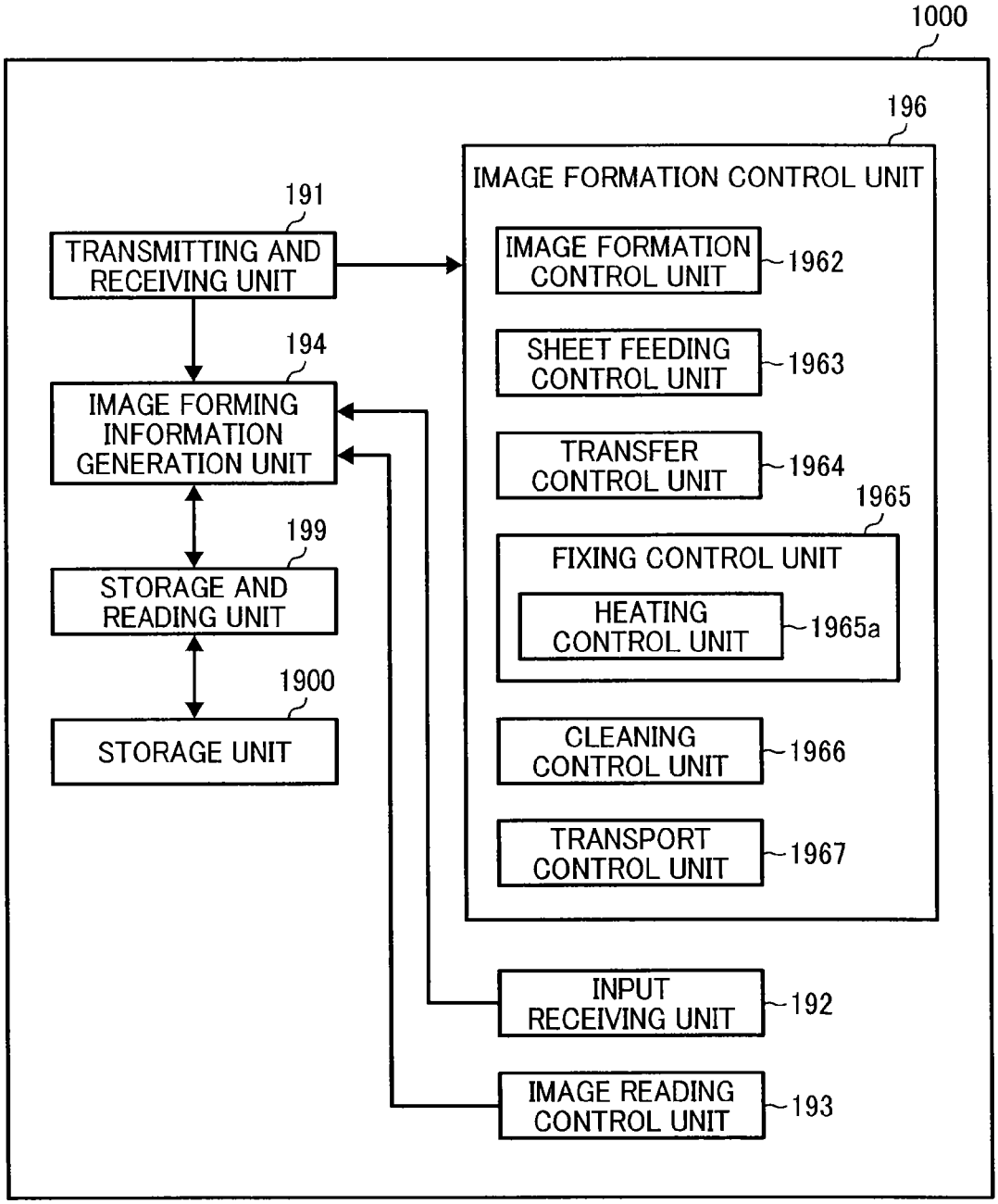
FIG. 5 is diagram illustrating a functional configuration of the controller of the image forming apparatus.

A functional configuration of the controller 1000 of the image forming apparatus 1 according to the present embodiment will be described with reference to FIG. 5. FIG. 5 is a diagram illustrating a functional configuration of the controller 1000 of the image forming apparatus 1.

The controller 1000 controls the operation of the image forming apparatus 1, and includes a transmitting and receiving unit 191, an input receiving unit 192, an image reading control unit 193, an image forming information generation unit 194, an image formation control unit 196, a storage and reading unit 199, and a storage unit 1900, as illustrated in FIG. 5. The functions of these units are implemented by the CPU 1011 in accordance with the programs stored in the ROM 1012*a* illustrated in FIG. 4. The storage unit 1900 is the ROM 1012*a* or the HD 1018 illustrated in FIG. 4.

The transmitting and receiving unit 191 realized by the network I/F 1021 illustrated in FIG. 4 receives RGB image information from an information processor or the like via a communication network. As described above, RGB image information is the information of the image that is to be formed on the sheet P represented by the respective brightness values of red (R), green (G), and blue (B) colors. The input receiving unit 192 receives information input through the control panel 18 illustrated in FIG. 1. The image reading control unit 193 controls the scanner 11 illustrated in FIG. 1 to optically read the image recorded on the document and generate RGB image information.

The image forming information generation unit 194 generates image forming information on the basis of the RGB image information received by the transmitting and receiving unit 191 or the RGB image information read by the scanner 11. Specifically, the image forming information generation unit 194 performs color space conversion processing on the RGB image information to calculate, for each of the pixels that make up the image to be formed on the sheet P, toner adhesion amounts Vc, Vm, Vy, and Vk corresponding to the cyan, magenta, yellow, and black colors, which are to adhere to the sheet P. Herein, the term "image forming information" refers to the information representing the toner adhesion amounts Vc, Vm, Vy, and Vk corresponding to the cyan, magenta, yellow, and black colors for each of the pixels, which are to adhere to the sheet P to form an image thereon.

In addition to the color space conversion processing, the image forming information generation unit 194 may perform under-color removal processing, shading correction, skew correction, and gamma correction, for example.

The image formation control unit 196 includes an image formation control unit 1962, a sheet feeding control unit 1963, a transfer control unit 1964, a fixing control unit 1965, a cleaning control unit 1966, and a transport control unit 1967. The image formation control unit 1962 controls the image forming units 12C, 12M, 12Y, and 12K. The sheet feeding control unit 1963 controls the sheet feeding unit 13. The transfer control unit 1964 controls the primary transfer rollers 144C, 144M, 144Y, and 144K, the secondary transfer roller 145, the intermediate transfer belt 143, and so forth. The fixing control unit 1965 controls the fixing unit 15, and includes a heating control unit 1965*a* that controlling the heating unit 153. The cleaning control unit 1966 controls the cleaning roller 161, the cleaning facing roller 162, and so forth of the cleaning unit 16. The transport control unit 1967 controls the transport of the sheet P transported on the sheet feeding belt 133 by not-illustrated transport rollers.

Figure 6:
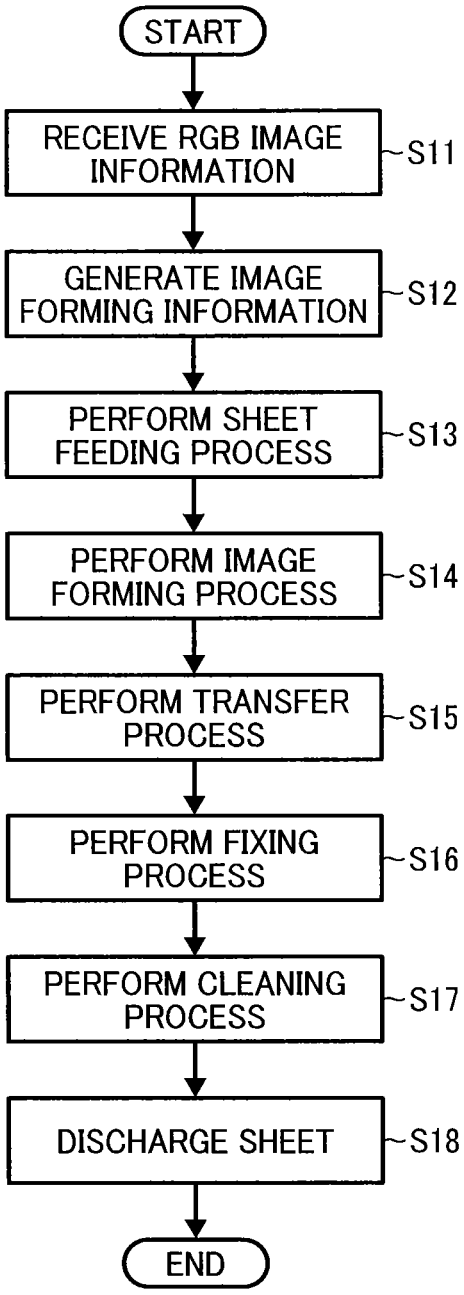
FIG. 6 is a process flowchart summarizing processing in which the image forming apparatus forms an image.
Figure 7:
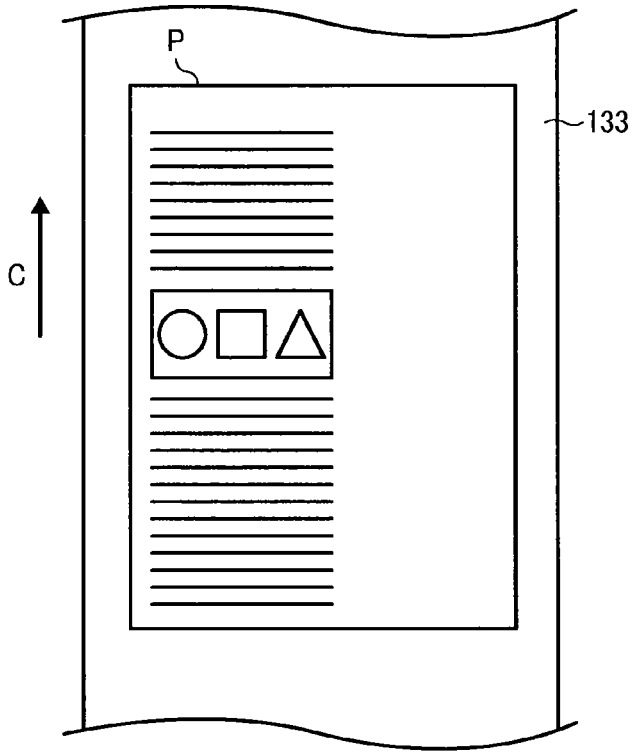
FIG. 7 is a diagram illustrating an example of an image formed on a sheet.

With reference to FIGS. 6 and 7, the processing performed by the image forming apparatus 1 will be described. FIG. 6 is a process flowchart summarizing processing in which the image forming apparatus 1 forms an image.

As illustrated in FIG. 6, the transmitting and receiving unit 191 first receives the RGB image information from, for example, an external information processor (step S11). After the transmitting and receiving unit 191 receives the RGB image information, the image forming information generation unit 194 generates the image forming information on the basis of the RGB image information (step S12).

Specifically, the image forming information generation unit 194 performs the color space conversion processing on the RGB image information to calculate the toner adhesion amounts Vc, Vm, Vy, and Vk. In addition to the color space conversion processing, the image forming information generation unit 194 may perform other types of typical image processing, such as under-color removal, color correction, and spatial frequency correction. The image forming information generation unit 194 calculates the toner adhesion amounts Vc, Vm, Vy, and Vk for all of the pixels on the sheet P and generates image forming information, i.e., the information representing the respective positions of the pixels on the sheet P and the toner adhesion amounts corresponding to those pixel positions.

After image forming information is generated at step S12, the sheet feeding unit 13 performs a sheet feeding process under the control of the sheet feeding control unit 1963 (step S13). Specifically, the sheet feeding roller 132 of the sheet feeding unit 13 picks up one of the sheets P stored in the sheet feeding tray 131 and places the sheet P onto the sheet feeding belt 133. The sheet feeding belt 133 moves in the direction of arrow A illustrated in FIG. 1 to transport the sheet P placed thereon to the registration roller pair 134. The transported sheet P reaches the registration roller pair 134, and stands by while being nipped by the registration roller pair 134 until the toner image formed on the outer circumferential surface of the intermediate transfer belt 143 reaches the secondary transfer roller 145. The registration roller pair 134 times the arrival of the sheet P between the secondary transfer roller 145 and the secondary transfer facing roller 146 so that the sheet P reaches the secondary transfer roller 145 at the same time as the toner image formed on the outer circumferential surface of the intermediate transfer belt 143 reaches the secondary transfer roller 145.

Under the control of the image formation control unit 1962, the image forming units 12C, 12M, 12Y, and 12K perform an image forming process of causing the respective toners to adhere to the photoconductor drums 122C, 122M, 122Y, and 122K (step S14). Specifically, in the image forming unit 12C, the charging unit 123C uniformly charges the outer circumferential surface of the photoconductor drum 122C, and the exposure unit 124C directs a laser beam onto the outer circumferential surface of the photoconductor drum 122C on the basis of the toner adhesion amount Vc of the image forming information generated by the image forming information generation unit 194. Thereby, an electrostatic latent image, to which the toner adhesion amount Vc of the toner of the cyan color is to adhere, is formed on the outer circumferential surface of the photoconductor drum 122.

After the formation of the electrostatic latent image on the outer circumferential surface of the photoconductor drum 122C, the development unit 125C develops the electrostatic latent image with the toner of the cyan color. Thereby, a toner image of the cyan color is formed on the outer circumferential surface of the photoconductor drum 122C. Similarly, toner images of the magenta, yellow, and black colors are formed on the respective outer circumferential surfaces of the photoconductor drums 122M, 122Y, and 122K. The image forming process for forming the toner image of the magenta, yellow, or black color is similar to that for forming the toner image of the cyan color. Thus, description thereof will be omitted.

After the formation of the toner images with the respective toners on the outer circumferential surfaces of the photoconductor drums 122C, 122M, 122Y, and 122K, a transfer process is performed under the control of the transfer control unit 1964 (step S15). Specifically, the primary transfer rollers 144C, 144M, 144Y, and 144K first supply the primary transfer bias to the intermediate transfer belt 143. Thereby, the toner images on the outer circumferential surfaces of the photoconductor drums 122C, 122M, 122Y, and 122K are primary-transferred onto the intermediate transfer belt 143.

The intermediate transfer belt 143 having the toner images transferred thereto moves in the direction of arrow B in FIG. 1 with the rotation of the drive roller 141 and the driven roller 142. The registration roller pair 134 times the arrival of the sheet P between the secondary transfer roller 145 and the secondary transfer facing roller 146 so that the sheet P reaches the secondary transfer roller 145 at the same time as the area of the intermediate transfer roller 143 formed with the toner images reaches the secondary transfer roller 145. When the sheet P sent by the registration roller pair 134 reaches the secondary transfer roller 145, the secondary transfer roller 145 nips the sheet P and the intermediate transfer roller 143 between the secondary transfer roller 145 and the secondary transfer facing roller 146 and supplies the secondary transfer bias to the sheet P. Thereby, the toner images formed on the outer circumferential surface of the intermediate transfer belt 143 are secondary-transferred onto the sheet P.

After the toner images are thus transferred to the sheet P, the fixing unit 15 performs a fixing process under the control of the fixing control unit 1965 (step S16). Specifically, the transported sheet P reaches the position at which the fixing roller 151 and the facing roller 152 are in contact with each other, and is nipped between the fixing roller 151 and the facing roller 152. In this process, the fixing roller 151 is heated by the heating unit 153. Thus, the sheet P is pressed and heated at a predetermined temperature at the same time. Thereby, the toners forming the toner images transferred to the sheet P are fused, and the sheet P having the fused toners adhering thereto is pressed by the fixing roller 151 and the facing roller 152. As a result, the toners are fixed on the sheet P.

After the toners are fixed on the sheet P by the fixing unit 15, the sheet P is transported to the cleaning unit 16 and subjected to a cleaning process under the control of the cleaning control unit 1966 (step S17). A detailed description of the cleaning process performed in step S17 is deferred.

After the cleaning process of the sheet P by the cleaning unit 16, the sheet P is discharged to the outside of the image forming apparatus 1 through the discharge port 10 (step S18).

A heating control performed in the fixing process at step S16 will now be described in detail.

The heating control unit 1965*a* first controls the heaters 153*a* to 153*g* of the heating unit 153 to heat the portions a to g of the fixing roller 151 on the basis of the image forming information generated by the image forming information generation unit 194.

Specifically, the sheet P having passed through the fixing roller 151 includes an image area and a blank area (non-image area). Herein, the term "image area" refers to a predetermined portion of the sheet P to which toner adheres, i.e., which has a toner adhesion amount greater than zero, and the term "blank area" refers to a predetermined portion of the sheet P to which no toner adheres, i.e., which has a toner adhesion amount of zero. In the image area of the sheet P, an image is formed with toner, which needs to be fixed on the sheet P. Therefore, any of the heaters 153*a* to 153*g* corresponding to the image area of the sheet P heats the corresponding one of the portions a to g of the fixing roller 151 such that the corresponding one of the portions a' to g' of the facing roller 152 for pressing the image area of the sheet P is heated to 160° C. Conversely, any of the heaters 153*a* to 153*g* corresponding to the blank area of the sheet P heats the corresponding one of the portions a to g of the fixing roller 151 such that the corresponding one of the portions a' to g' of the facing roller 152 for pressing the blank area of the sheet P is heated to 110° C. The control the temperature is based on the temperature of the facing roller 152 measured by the temperature gauge 155.

FIG. 7 is a diagram illustrating an example of the image formed on the sheet P. In the present example, the sheet P has the image area on the left side thereof formed with an image and the blank area on the right side thereof formed with no image. The sheet P is subjected to the fixing process while being moved in the direction of arrow C. In the fixing process on such a sheet P, the heating control unit 1965*a* controls the heaters 153*a* to 153*d* to heat the portions a to d of the fixing roller 151 such that the portions a' to d' of the facing roller 152 corresponding to the image area of the sheet P are heated to 160° C. Further, the heating control unit 1965*a* controls the heaters 153*e* to 153*g* to heat the portions e to g of the fixing roller 151 such that the portions e' to g' of the facing roller 152 corresponding to the blank area of the sheet P are heated to 110° C.

As illustrated in FIG. 3, the heaters 153*a* to 153*g* heat the portions a to g of the fixing roller 151. As the portions a to g of the fixing roller 151 are heated to a high temperature by the heaters 153*a* to 153*g*, the heat is conducted to and heats the portions a' to g' of the facing roller 152, which are in contact with the portions a to g of the fixing roller 151. With the portions a to g of the fixing roller 151 heated by the heaters 153*a* to 153*g* at different temperatures, therefore, the portions a' to g' of the facing roller 152 are also heated to different temperatures.

In the thus-configured image forming apparatus 1, the cleaning roller 161 and the cleaning facing roller 162 of the cleaning unit 16 disposed facing each other as illustrated in FIG. 1 perform the cleaning process of the sheet P. In the present embodiment, the cleaning roller 161 is a conductive brush roller, and the cleaning facing roller 162 includes a resistance layer 162-2 forming the outer circumferential surface thereof, as illustrated in FIG. 8.

Figure 8:
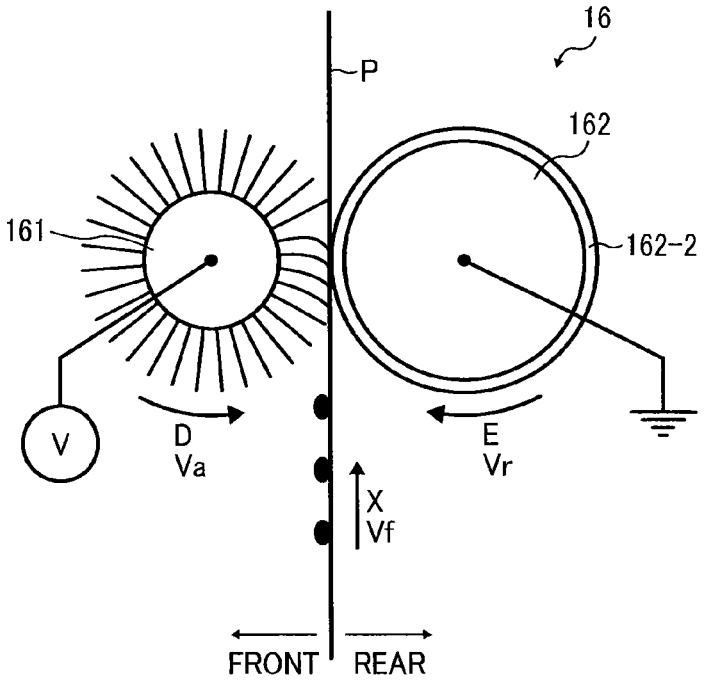
FIG. 8 is a diagram illustrating a configuration of a cleaning unit included in the image forming apparatus.

FIG. 8 is a diagram illustrating a configuration of the cleaning unit 16. In FIG. 1, the cleaning roller 161 and the cleaning facing roller 162 are disposed facing each other in the vertical direction in the drawing, and the sheet P is transported leftward in the drawing. For convenience, FIG. 8 illustrates the cleaning roller 161 and the cleaning facing roller 162 disposed facing each other in the horizontal direction in the drawing and the sheet P transported upward in the drawing. The sheet P has a front surface having toner adhering thereto and a rear surface on the rear side of the front surface (referred to as FRONT and REAR, respectively, in the drawings). In FIG. 8, the front surface of the sheet P is in contact with the cleaning roller 161. It is to be noted that the above description of the cleaning roller 161 and the cleaning facing roller 162 also applies to later-described second to fourth embodiments illustrated in FIGS. 9 to 11.

The sheet P having passed through the fixing unit 15 is transported in the direction of arrow X in FIG. 8. In this process, the cleaning roller 161 rotates in the direction of arrow D, and the cleaning facing roller 162 rotates in the direction of arrow E, to thereby nip and transport the sheet P in the direction of arrow X (i.e., recording medium transport direction). This configuration allows the cleaning of the sheet P without interfering with the transport of the sheet P subjected to the fixing process. Herein, the term "cleaning" refers to removal of unfixed toner adhering to the sheet P.

The cleaning control unit 1966 controls the rotation of the cleaning roller 161 and the cleaning facing roller 162 such that the cleaning roller 161 rotates at a circumferential speed Va and the cleaning facing roller 162 rotates at a circumferential speed Vr. Further, the transport control unit 1967 controls the transport of the sheet P such that the sheet P having passed through the fixing unit 15 is transported in the direction of arrow X at a speed (i.e., linear velocity) Vf. In this process, if the circumferential speed Vr of the cleaning facing roller 162 is set to be faster than the speed Vf of the sheet P, the sheet P is prevented from slackening in the cleaning unit 16. Further, if the circumferential speed Va of the cleaning roller 161 is set to be faster than the circumferential speed Vr of the cleaning facing roller 162, the sheet P is stably transported in the cleaning unit 16. That is, it is preferable to set the respective speeds Va, Vr and Vf such that Va>Vr>Vf.

In the cleaning process, a potential gradient having a polarity opposite to the charging polarity of the toner is formed between the cleaning roller 161 and the cleaning facing roller 162. That is, on the assumption that the toner is negatively charged, the cleaning roller 161 is supplied with a positive constant potential V, and the cleaning facing roller 162 is fixed to a ground potential 0 V, as in the example illustrated in FIG. 8. Hereinafter, such a potential gradient will be referred to as cleaning bias. With the cleaning bias, the negatively charged unfixed toner is attracted to the cleaning roller 161 in contact with the front surface of the sheet P. The constant potential V supplied to the cleaning roller 161 may be set to any value with which the potential gradient causing the cleaning roller 161 to attract the unfixed toner is formed between the cleaning roller 161 and the cleaning facing roller 162.

The above-described formation of the potential gradient is illustrative. Therefore, the cleaning roller 161 and the cleaning facing roller 162 are not necessarily required to be set to the positive constant potential V and the ground potential 0 V, respectively, as long as the potential gradient formed therebetween causes the cleaning roller 161 to attract the unfixed toner.

As the sheet P is transported through the thus-configured cleaning unit 16, the charged unfixed toner is transferred to the cleaning roller 161. Further, controlling the cleaning bias to a constant voltage as described above has an effect of preventing a change in voltage due to the resistance of the sheet P, thereby preventing an excessive rise in voltage.

As described above in the present embodiment, it is preferable to employ a conductive brush roller as the cleaning roller 161 that comes into contact with the front surface of the sheet P. The conductive brush roller allows the removal of foreign substances such as the unfixed toner without impairing the image quality of the image on the front surface of the sheet P immediately after the fixing process.

Further, it is preferable that the cleaning facing roller 162 that comes into contact with the rear surface of the sheet P includes the resistance layer 162-2 forming the outer circumferential surface thereof, as described above in the present embodiment. The sheet P to be cleaned has a variety of widths. When supplied with the cleaning bias, therefore, the cleaning roller 161 and the cleaning facing roller 162 may be electrically connected to each other in, for example, regions outside the sheet P in the width direction of the sheet P, i.e., regions in which the sheet P is absent, depending on the width of the sheet P. Such electrical connection prevents the formation of the above-described potential gradient, thereby preventing the cleaning process. Therefore, the resistance layer 162-2 is provided to form the outer circumferential surface of the cleaning facing roller 162 that comes into contact with the rear surface of the sheet P, to thereby prevent electrical connection between the cleaning roller 161 and the cleaning facing roller 162 and guarantee the cleaning process.

Description will now be given of a cleaning unit 16*b* according to the second embodiment of the present invention. The cleaning unit 16*b* according to the present embodiment is applicable to the foregoing image forming apparatus 1, for example. Since the details of the image forming apparatus 1 have already been described above, description thereof will be omitted. Further, the description of the components of the cleaning unit 16*b* the same as those of the first embodiment will also be omitted.

Figure 9:
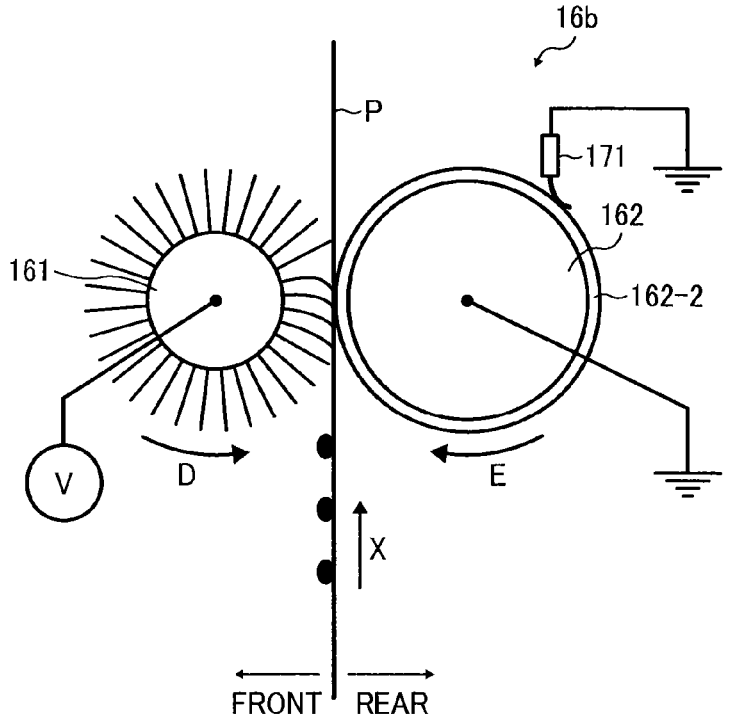
FIG. 9 is a diagram illustrating a configuration of a cleaning unit according to a second embodiment of the present invention.

FIG. 9 is a diagram illustrating a configuration of the cleaning unit 16*b* according to the second embodiment. The cleaning unit 16*b* according to the second embodiment includes a discharging brush 171 in addition to the configuration of the cleaning unit 16 according to the first embodiment.

The discharging brush 171, which is in contact with the cleaning facing roller 162, prevents the outer circumferential surface of the cleaning facing roller 162 having the resistance layer 162-2 from being electrostatically charged, for example, thereby allowing stable transport of the sheet P. The discharging brush 171 is electrically grounded.

In the present embodiment, the discharging brush 171 is electrically grounded with the cleaning roller 161 and the cleaning facing roller 162 set to the positive constant potential V and the ground potential, respectively. As described above in the first embodiment, however, the cleaning bias supplied to the cleaning roller 161 and the cleaning facing roller 162 may have a different potential.

With the above-described configuration, even if the outer circumferential surface of the cleaning facing roller 162 having the resistance layer 162-2 is charged, it is possible to discharge the charged outer circumferential surface. Accordingly, it is possible to stably perform the cleaning process while transporting the sheet P.

Description will now be given of a cleaning unit 16*c* according to the third embodiment of the present invention. The cleaning unit 16*c* according to the present embodiment is applicable to the foregoing image forming apparatus 1, for example. The description of the details of the image forming apparatus 1 and the components of the cleaning unit 16*c* the same as those of the first embodiment will be omitted.

Figure 10:
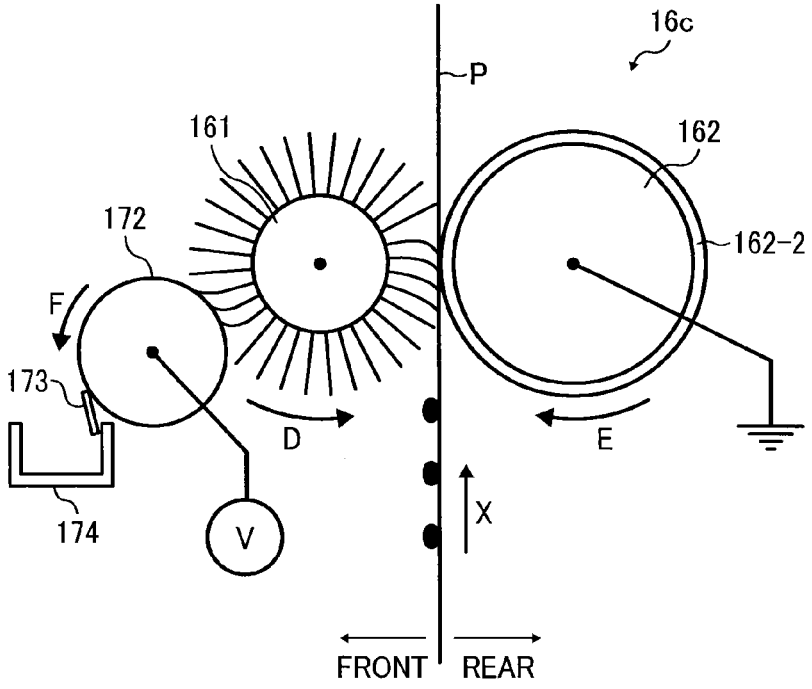
FIG. 10 is a diagram illustrating a configuration of a cleaning unit according to a third embodiment of the present invention.

FIG. 10 is a diagram illustrating a configuration of the cleaning unit 16*c* according to the third embodiment. The cleaning unit 16*c* according to the third embodiment includes an electrode roller 172, a scraper 173, and a recovery vessel (i.e., container) 174 in addition to the configuration of the cleaning unit 16 according to the first embodiment.

The electrode roller 172 is supplied with a positive constant voltage V and in contact with the conductive brush cleaning roller 161. Thus, the cleaning roller 161 is supplied with a positive constant potential V. Further, the cleaning facing roller 162 is electrically grounded. That is, the potential gradient corresponding to the positive constant potential V is formed between the cleaning roller 161 and the cleaning facing roller 162, thereby causing the cleaning roller 161 to attract foreign substances, such as the negatively charged toner, from the sheet P. The foreign substances such as the toner attracted to the cleaning roller 161 are then transferred to and recovered by the electrode roller 172.

The cleaning unit 16*c* according to the present embodiment further includes the scraper 173 disposed to be in contact with the electrode roller 172 to scrape foreign substances therefrom. The foreign substances recovered by the electrode roller 172 are scraped from the electrode roller 172 and stored in the recovery vessel 174 by the scraper 173.

With this configuration, the foreign substances attracted to the cleaning roller 161 are recovered by the electrode roller 172, removed by the scraper 173, and stored in the recovery vessel 174. Accordingly, the outer circumferential surface of the electrode roller 172 is kept clean, and the cleaning process is stably performed over an extended period of time.

Description will now be given of a cleaning unit 16*d* according to the fourth embodiment of the present invention. The cleaning unit 16*d* according to the present embodiment is applicable to the foregoing image forming apparatus 1, for example. The description of the details of the image forming apparatus 1 and the components of the cleaning unit 16*c* the same as those of the first or third embodiment will be omitted.

Figure 11:
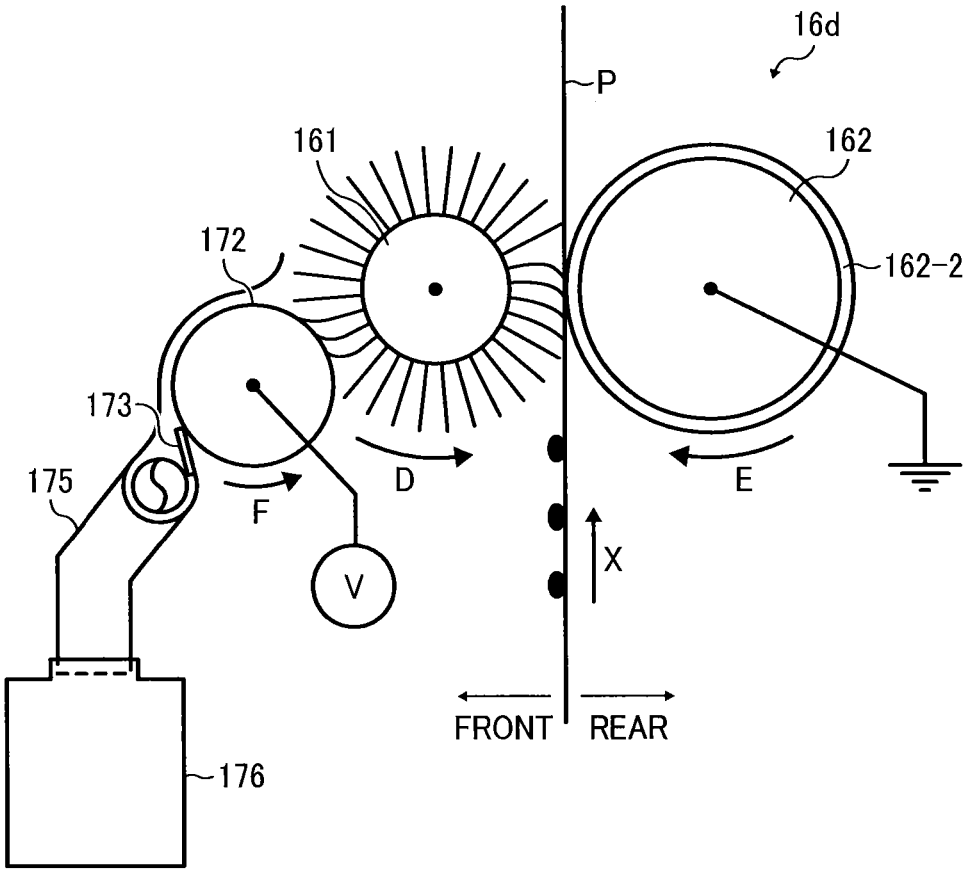
FIG. 11 is a diagram illustrating a configuration of a cleaning unit according to a fourth embodiment of the present invention.

FIG. 11 is a diagram illustrating a configuration of the cleaning unit 16*d* according to the fourth embodiment. The cleaning unit 16*d* according to the fourth embodiment corresponds to the configuration of the cleaning unit 16*c* according to the third embodiment, with the recovery vessel 174 according to the third embodiment replaced by a waste toner transport tube 175 and a waste toner recovery vessel 176.

In the fourth embodiment, the foreign substances scraped from the electrode roller 172 by the scraper 173 are stored in the waste toner recovery vessel 176 through the waste toner transport tube 175 formed by a duct, for example. It is preferable that the waste toner recovery vessel 176 is also used as a container for storing waste toner from the photoconductor drums 122C, 122M, 122Y, and 122K and the intermediate transfer belt 143 in the image forming apparatus 1, i.e., as a container commonly used in an image forming apparatus to recover waste toner from photoconductors and an intermediate transfer member.

With this configuration, the cleaning unit 16*d* and the image forming apparatus 1 are simplified in structure and reduced in size, and facilitate maintenance work.

According to embodiments of the present invention, a recording medium is cleaned after a fixing process of a fixing unit, thereby preventing a hand of a person touching the recording medium from being stained with unfixed toner.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, the disclosure of the present invention may be practiced otherwise than as specifically described herein.

What is claimed is:

1. An image forming apparatus comprising:

a fixing unit including a plurality of local heaters, each local heater heating a separate portion of a recording medium carrying toner on a front surface of the recording medium to fix the toner onto the front surface of the recording medium; and a cleaning unit including a first roller and a second roller, the cleaning unit removing unfixed toner adhered to the recording medium after the fixing of the toner by the fixing unit, wherein the second roller is in contact with a rear surface of the recording medium, and the second roller includes a resistance layer forming an outer surface of the second roller.

2. The image forming apparatus according to claim 1, wherein the first roller and the second roller rotate to transport therebetween the recording medium in a recording medium transport direction.

3. The image forming apparatus according to claim 2, wherein the first roller is in contact with the front surface of the recording medium, and a potential gradient is formed between the first roller and the second roller to cause the unfixed toner adhering to the recording medium to be attracted to the first roller.

4. The image forming apparatus according to claim 3, wherein the potential gradient is formed between the first roller and the second roller by a constant voltage supplied thereto.

5. The image forming apparatus according to claim 2, wherein the first roller is in contact with the front surface of the recording medium, and the first roller is an electrically conductive brush roller.

6. The image forming apparatus according to claim 2, wherein the first roller is in contact with the front surface of the recording medium, the first roller is a conductive roller, the image forming apparatus further comprises an electrode roller in contact with the conductive roller, and a potential gradient is formed between the electrode roller and the second roller to cause the unfixed toner adhering to the recording medium to be attracted to the first roller.

7. The image forming apparatus according to claim 6, further comprising:

a scraper that scrapes toner from the electrode roller, the scraper being in contact with the electrode roller.

8. The image forming apparatus according to claim 7, further comprising:

a container that stores the toner scraped by the scraper from the electrode roller.

9. The image forming apparatus according to claim 8, further comprising:

a transport tube between the scraper and the container, the toner scraped by the scraper from the electrode roller being transported through the transport tube to the container, wherein the container serves as a waste toner recovery vessel of the image forming apparatus.

10. The image forming apparatus according to claim 1, further comprising:

a discharging brush that is in contact with the resistance layer forming the surface of the second roller.

11. An image forming apparatus comprising:

a fixing unit including a plurality of local heaters, each local heater heating a separate portion of a recording medium carrying toner to fix the toner on the recording medium;

a cleaning unit including a first roller and a second roller, the cleaning unit removing unfixed toner adhered to the recording medium after the fixing of the toner by the fixing unit; and a control circuit that controls transport of the recording medium and the rotation of the first roller and the second roller so that $V_a > V_r > V_f$, wherein $V_a$ is a linear velocity for transporting the recording medium after the fixing of the toner performed by the fixing unit, $V_r$ is a circumferential speed of the first roller, and $V_f$ is a circumferential speed of the second roller.

12. The image forming apparatus according to claim 11, wherein the first roller and the second roller rotate to transport therebetween the recording medium in a recording medium transport direction.

13. The image forming apparatus according to claim 12, wherein a potential gradient is formed between the first roller and the second roller to cause the unfixed toner adhering to the recording medium to be attracted to the first roller.

14. The image forming apparatus according to claim 13, wherein the potential gradient is formed between the first roller and the second roller by a constant voltage supplied thereto.

15. The image forming apparatus according to claim 12, wherein the first roller is an electrically conductive brush roller.

16. The image forming apparatus according to claim 12, wherein the first roller is a conductive roller, the image forming apparatus further comprises an electrode roller in contact with the conductive roller, and a potential gradient is formed between the electrode roller and the second roller to cause the unfixed toner adhering to the recording medium to be attracted to the first roller.

17. The image forming apparatus according to claim 16, further comprising:

a scraper that scrapes toner from the electrode roller, the scraper being in contact with the electrode roller.

18. The image forming apparatus according to claim 17, further comprising:

a container that stores the toner scraped by the scraper from the electrode roller.

19. The image forming apparatus according to claim 18, further comprising:

a transport tube between the scraper and the container, the toner scraped by the scraper from the electrode roller being transported through the transport tube to the container, wherein the container serves as a waste toner recovery vessel of the image forming apparatus.

20. The image forming apparatus according to claim 11, further comprising:

a discharging brush that is in contact with a resistance layer forming a surface of the second roller.

* * * * *